United States Patent [19]

Pralus

[11] Patent Number: 5,026,957

[45] Date of Patent: Jun. 25, 1991

[54] APPARATUS FOR BAKING OR HEATING VARIOUS PRODUCTS BY APPLICATION OF MICROWAVES AND OVEN APPLYING SAME

[76] Inventor: Georges Pralus, Briennon, 42720 Pouilly Sous Charlieu, France

[21] Appl. No.: 315,584

[22] Filed: Feb. 27, 1989

[30] Foreign Application Priority Data

Mar. 3, 1988 [FR] France ..... 88 02993

[51] Int. Cl.[5] ..... H05B 6/80

[52] U.S. Cl. ..... 219/10.55 M; 219/10.55 E; 219/10.55 F; 99/DIG. 14; 426/243

[58] Field of Search ..... 219/10.55 E, 10.55 F, 219/10.55 B, 10.55 R, 10.55 M, 401; 99/DIG. 14, 451; 426/243, 241

[56] References Cited

U.S. PATENT DOCUMENTS

| | | | |
|---|---|---|---|
| 2,888,542 | 5/1959 | Mork | 219/10.55 F |
| 3,854,023 | 12/1974 | Levinson . | |
| 4,154,861 | 5/1979 | Smith | 219/10.55 E |
| 4,316,070 | 2/1982 | Prosise et al. . | |
| 4,449,026 | 5/1984 | Satoh | 219/10.55 B |
| 4,481,392 | 11/1984 | Nibbe et al. | 219/10.55 E |
| 4,481,395 | 11/1984 | Smith et al. | 219/10.55 E |
| 4,633,052 | 12/1986 | Beavers et al. | 219/10.55 E |
| 4,689,458 | 8/1987 | Levendusky et al. . | |
| 4,705,927 | 11/1987 | Levendusky et al. | 219/10.55 E |
| 4,728,762 | 3/1988 | Roth et al. | 219/10.55 E |

FOREIGN PATENT DOCUMENTS

3030755A1 3/1981 Fed. Rep. of Germany .

*Primary Examiner*—Philip H. Leung
*Attorney, Agent, or Firm*—Bacon & Thomas

[57] ABSTRACT

The baking-heating according to the invention is characterized in that it consists in defining in the application cavity, a baking-heating enclosure, open to the front of the oven at least coincidingly with the glass of the door and designed to contain the products, by means of an element insertable in the cavity, comprising at least one wall interposed between the enclosure and the generator and made from a porous material which is permeable to microwave energy, and provided with a waterproof coating except on its face directed toward the enclosure. The invention finds an application in the baking or heating of food products.

16 Claims, 3 Drawing Sheets

APPARATUS FOR BAKING OR HEATING VARIOUS PRODUCTS BY APPLICATION OF MICROWAVES AND OVEN APPLYING SAME

FIELD OF THE INVENTION

The present invention relates to the field of heating and baking of various products, and more particularly to heating and baking by application of microwaves.

BACKGROUND OF THE INVENTION

The microwave heating or baking of various products is performed by placing the products on a support which is in turn placed in a closed application cavity.

Although it is possible, by applying microwaves, to heat or to bake a product, it has however been found that in proceeding in this way, the heated or baked product, no longer has the same qualities as those exhibited by the same product which has been heated or baked by different means.

This is especially so in the preferred hut non-exclusive field of application which is that of heating and baking of food products, known to lose their organoleptic and/or nutritional qualities when they have been subjected to the action of microwaves.

The physical nature of certain food products can even, in some cases, be affected by splitting or bursting of the outside skins, teguments, pods or other shells.

This seems to be due to the disturbance of the free and trapped molecules of water whose dissociation causes the release of diffusing vapors, carrying with them some at least of the principles of the product, which is then in a condition that can be termed as partly degraded.

In an attempt to overcome this drawback and to prevent the burst skins, teguments or other shells from polluting the application cavity, it bas sometimes been proposed to place over the products a bell-type cover, made from a microwave transparent material, such as for example glass or plastic material.

When such a cover is used, it is found that the basic phenomenon described hereinabove, and due to the application of the microwaves, still exists, but that the water in vapor phase released by the products tends to liquefy in contact with the cover and to turn into a liquid phase in the confining enclosure, forming a layer of liquid in the tray, in which the product stands at least partly.

If the use of such a cover prevents projections, it does not however solve the fundamental problem of dispersion and loss of some of the principles of the products, or that of extraction of large quantities of water molecules, two factors which are responsible for changing the properties of the products, such as the organoleptic and nutritional properties of food products.

In addition to the aforesaid drawbacks, it must also be noted that the application of microwaves, particularly when cooking meat, does not permit a controlled centripetal progression of the baking of the product, to achieve, depending on the exposure period, a superficial or intermediate baking, or a baking to the core, thus permitting to meet the cooking requirements conventionally called "rare", "medium rare", and "medium".

The prior art, and in particular French Patent Application No. 82 03 328 (2 501 031) has tried to propose a solution to this problem with a steam cooking apparatus, which is insertable in a microwave oven. According to the teaching of said patent, the apparatus comprises a container previous to microwaves and containing, at least partly, another container reflecting the microwaves and having a perforated base spaced from the bottom of the microwave-permeable container, thereby defining a tank capable of storing water. The apparatus is completed by a cover.

Assuming that positive results are obtained with this apparatus, it should be noted that its structure is complex and bulky and presents two negative and redhibitory factors for wide commercial distribution. The first factor is that of cost and practical use, such as for example installation and cleaning. The second factor is linked to the substantial reduction of the actual serviceable cavity and of the application cavities of microwave ovens.

Another prior art solution has been proposed by U.S. Pat. No. 3 854 023 and consists in a container with a cover intended to contain food products. The container and cover are produced in a microwave-permeable and porous material. This technique is not really satisfactory in that it implies the use of an equipment which is not adapted to microwave ovens and in particular which does not allow any variable perception of the heating or baking process cycle.

OBJECT OF THE INVENTION

It is the object of the present invention to eliminate the aforesaid drawbacks by proposing a new apparatus for heating or baking products, and more particularly food products, by applying microwave energy.

The apparatus according to the invention is particularly designed to preserve the intrinsic qualities of the products, and in particular the organoleptic and nutritional properties of a food product, and to afford a possibility of controlling the baking or heating to a surface or below surface or deep level.

Another object of the apparatus according to the invention is to allow a microwave heating or baking which will preserve the soft nature of the foods, as if said foods had been cooked in a conventional oven or steamed.

Yet another object of the invention is to propose a baking or heating apparatus offering the added advantage of constituting at least partly, a heat accumulator making it possible to keep hot, for a predetermined period after the baking or heating operation, the product which has been subjected to the application of microwaves.

These objects are reached according to the invention with a process for baking-heating various food products in a microwave oven defining an application cavity connected to a microwave generator and accessible through a transparent glass-door, characterized in that it consists in defining inside the application cavity, a baking-heating enclosure open to the front of the oven, at least coincidingly with the glass of the door, and designed to contain the products by means of an element which can be inserted into the cavity, which element comprises at least one wall situated between the enclosure and the generator and made from a porous material permeable to microwave energy and coated with a water-proof layer, except on its face directed toward the enclosure.

BRIEF DESCRIPTION OF THE DRAWINGS

The invention will be more readily understood on reading the following description with reference to the accompanying drawings, in which.

DETAILED DESCRIPTION OF PREFERRED EMBODIMENTS

Figure 1:
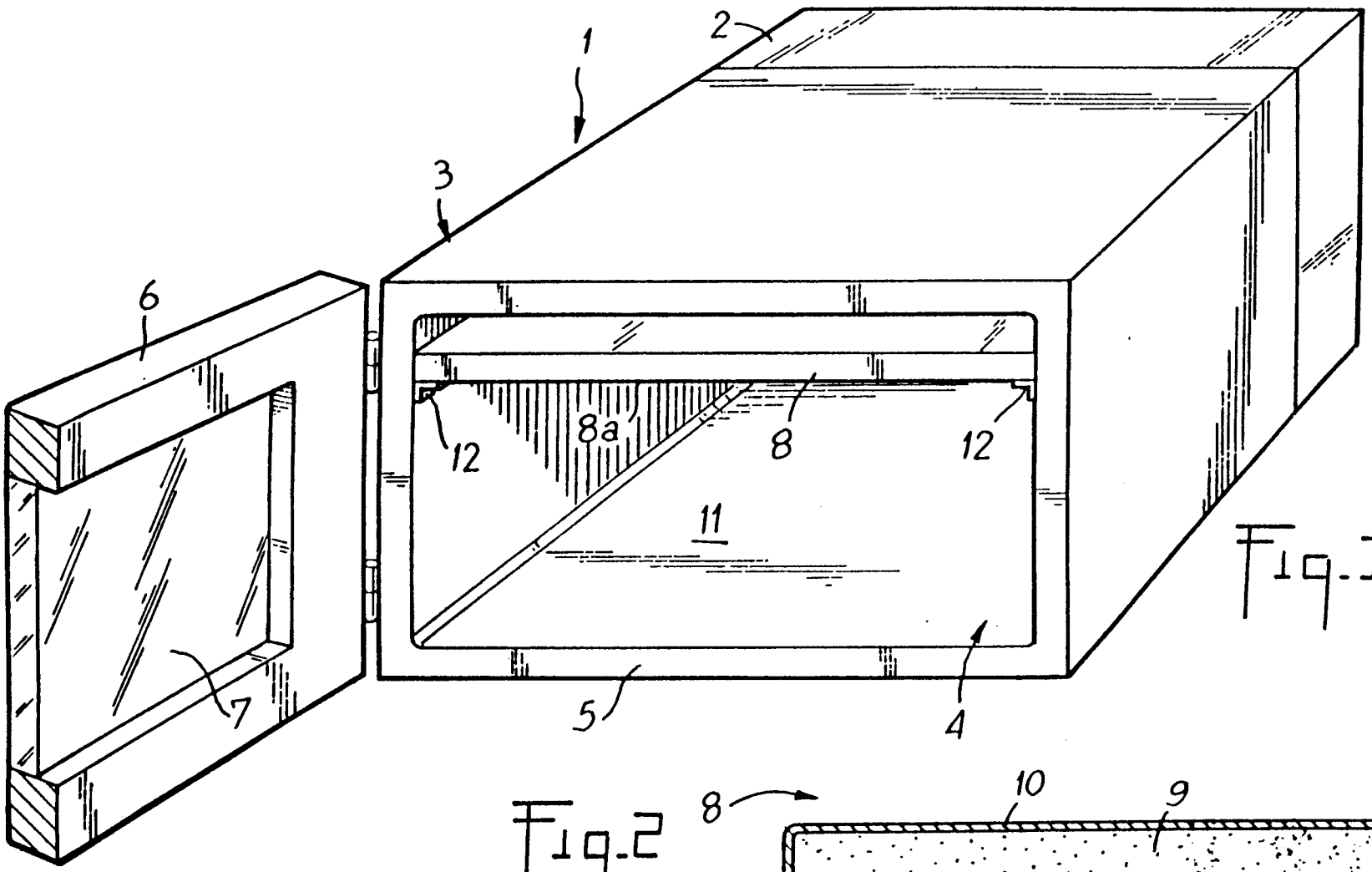
FIG. 1 is a perspective view of a first embodiment of the baking apparatus according to the invention.

Referring first to FIG. 1, this shows a microwave oven 1 comprising, for example at the back, a generator compartment 2 and, at the front, a utilizing compartment 3 defining an application cavity 4, open to the front 5 and equipped with a door 6 provided, in the conventional way, with a glass pane 7.

Figure 2:
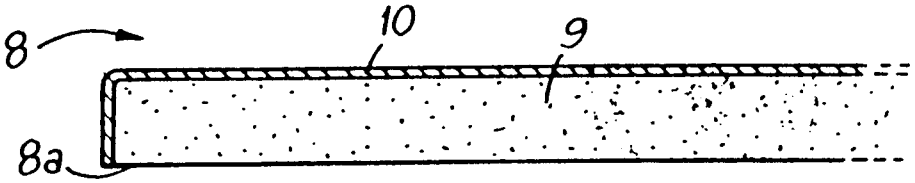
FIG. 2 is a perspective view in partial cross-section, showing on an enlarged scale, one detail of embodiment of the apparatus.

According to a first embodiment, the apparatus which constitutes an element insertable in the cavity 4, is composed of a plate 8, produced as illustrated in FIG. 2, from a porous material 9, such as clay or earthenware, compatible for use with foods, and permeable to microwaves. The porous nature of the material making up the plate 8 should be understood as fulfilling the requirement of being able to retain a reserve of water.

Preferably, the thickness of the plate is constant and selected as a function of the water-retention power that it is expected to have. The plate is covered over all its faces excepting one main face such as 8*a*, with a coating 10 of waterproof material transparent to microwaves, preferably suitable for use with foods and capable of withstanding relatively high temperatures at least equal to 100° C. The coating 10 may be of any other suitable nature compatible with material 9 and for example, it can be formed by a cracking, glazing or enameling treatment.

Plate 8 is so produced as to he insertable in the cavity 4, in such a way as to be interposed between the products to be baked or heated and the microwave generator. Generally, plate 8 is positioned opposite the opening of the wave guide. Said plate 8 thereby defines, inside cavity 4, a baking-heating enclosure 11 of which at least one side is formed by the material constituting the plate. The method of inserting plate 8 is selected, in all cases, so that the face 8*a*, not covered with the coating 10, is oriented inward of the enclosure 11. To this effect, it is possible to provide some of the walls of the cavity 4, with inserting means 12 oriented in such a way as to prevent any inaccurate positioning of the plate 8.

During use, plate 8 is impregated with water through its retention face, by any appropriate means, such as a spray-dispenser. Storage water may also be obtained by soaking.

After switching on, the microwave energy distributed in enclosure 11, inside which has been placed a product for baking or heating, traverses element 8 before it reaches the product and agitates the water molecules retained in the material 9. Plate 8 then acts as an intermediate harrier, generating a vaporization of the water contained therein, which, because of the coating 10, diffuses through the confining volume of the enclosure 11. The vapor phase thus diffused occupies the whole of the enclosure, undergoes agitation caused by the microwaves which have traversed the wall 8 and thus contributes to creating a heating or baking atmosphere which can be compared to the conventional steaming method.

This steaming atmosphere, close to saturation, soaks up the product and opposes the vaporization of the free water molecules trapped in said product, which latter is then preserved without degradation in a condition which can withstand a rise in heating and baking temperature caused by the microwaves reaching it.

In the case of food products, the molecules of water trapped inside the product, thus contribute to preserving, together with their own gustative and vitamin principles, the organoleptic and nutritional properties of those foods. These internal molecules of water also enable the temperature to be increased progressively toward the inside, from the periphery of the food product which is then subjected to a baking progressing also in the same direction. It is then possible to bake products either to the core or not, and as far as meats are concerned, to perform rare or medium bakings, which used to be known as impossible to achieve by microwave heating.

The vapor atmosphere also makes it possible to obtain a non-baked juice, resulting either from the addition of a liquid, or from condensation, or even from the flow of organic liquids, and to have a cooked dish showing characteristics of appetency comparable to those obtained with the conventional cooking methods.

The mass of material 9 constitutes a reserve of water sufficient to last through a long heating or baking period.

Figure 3:
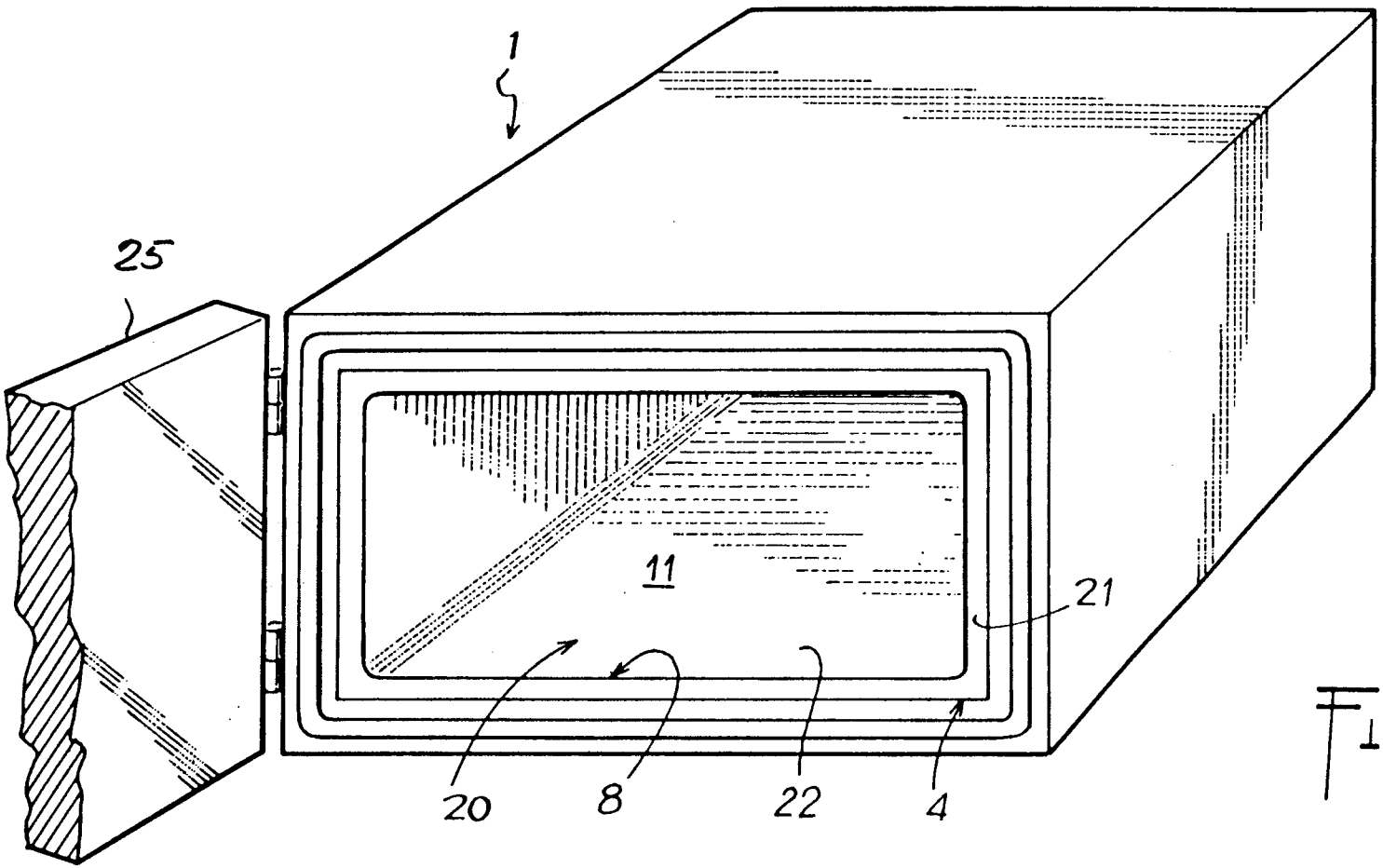
FIG. 3 is a perspective view illustrating another embodiment of the object of the invention.

FIG. 3 illustrates an embodiment according to which the insertable element 8 is produced in the form of a bell 20, for example a parallelepipedal bell. Said bell is produced from a porous material which meets the requirements set out above, and has no coating 10 over its inner faces. The bell is insertable in the cavity 4, defining therein an enclosure 11, and is provided, in its peripheral wall with an open section 21 designed to face frontwardly. Bell 20 may be provided with a base 22 which constitutes the sole-plate of the enclosure 11. Said bell 20 can have any suitable geometrical shape and preferably a shape which is homothetic to cavity 4.

Figure 4:
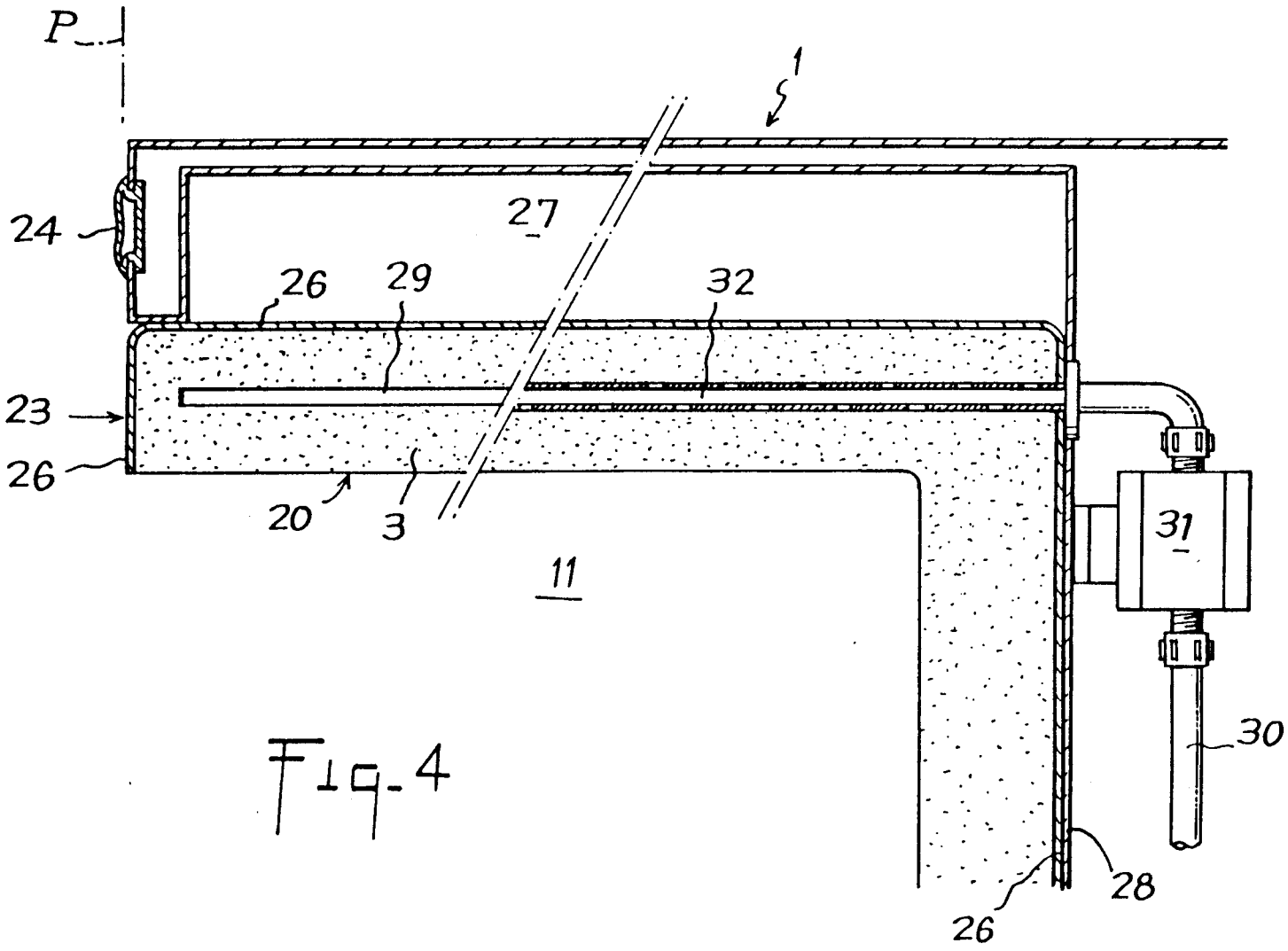
FIG. 4 is an elevational cross-section of the embodiment shown in FIG. 3.

According to the embodiment shown in FIG. 4, the element 8 is constituted by a casing 20 set in a microwave oven 1. Said casing 20 is produced so as to constitute an internal lining for the oven and to define the enclosure 11. The casing 20 is designed to have, as in the preceding example, an open face which coincides with the front of the oven through which are introduced or taken out the products or foodstuffs to be heated or baked. Said open face is preferably defined by a flat edge 23 which is inscribed in plane P of the front face and which is provided with a seal 24 adapted to cooperate with a door 25.

Said casing 20 is produced, as in the preceding example, from a porous material 3 and is coated, with the exception of its inner faces defining enclosure 11, with a layer 26 exhibiting the same characteristics as coating 10.

Said casing 20 is associated to, mounted or adapted in the oven 1 in such a way as to be adJacent at least by one external face to a wave guide 27 equipped with a microwave generator not shown in the drawings. It is understood that the technical means used for generating and conveying the microwaves are known to any one skilled in the art and do not come within the scope of the invention. Thus, the microwaves transmitted by the guide 27 are distributed through at least one wall of the envelope 20 into the enclosure 11 in which they are reflected by an internal jacket 28 surrounding the faces of the casing which are not adjacent to the guide 27.

Advantageously, ducts 29 are defined through the thickness of the casing 20, said ducts being connected to a water admission circuit 30 controlled by a cock 31. These means make it possible to create a reserve of water through the thickness of the porous material.

Ducts 29 may be distributed out in any suitable manner for helping the water to disperse to disperse through the porous material. Ducts 29 may be simple holes provided in the thickness of the porous material, or they can be inserted perforated tubes 32.

The cock or cocks 31 are preferably constituted by electrovalves, which are fed for example, by controlling a selective switch or a timing switch, the operation of which is included in the oven working cycle.

In this way, the user can program a normal operation of the oven or an operation with production and confining of steam.

The invention is not in any way limited to the description given herein above and on the contrary covers any modification which can be brought thereto without departing from its scope.

What is claimed is:

1. A process of baking or heating products in a microwave oven through the action of steam which comprises the steps of: forming an enclosure in a microwave oven; said enclosure having a water containing porous microwave permeable layer facing the interior of the enclosure and a water proof microwave permeable layer facing the exterior of the enclosure to confine steam within said enclosure; placing a product to be baked or heated within the enclosure; and energizing the microwave oven to vaporize the water and form steam whereby said steam is prevented from passing through the water proof layer and said steam thereby enters the enclosure containing the product so that the product is at least partially cooked by the action of the steam.

2. A process of baking or heating products in a microwave oven having a microwave generator and a cooking compartment; said process comprising the steps of: 1) inserting a porous wall element into the cooking compartment of the microwave oven; said element having a waterproof layer on one side and an exposed porous layer on the other side; said porous layer being permeable to microwaves and said waterproof layer being permeable to microwaves and capable of resisting temperatures of at least 100° C.; said porous wall element having water contained in the pores thereof; 2) positioning said porous wall element in the cooking compartment to define an enclosure surrounded by the wall and the cooking compartment; said wall being oriented so that the waterproof layer faces the microwave generator and the exposed porous layer faces in the opposite direction towards the side of the enclosure so that microwaves can pass through the waterproof and porous layers and vaporize the water in the pores; 3) placing a product to be cooked within the enclosure formed between the wall and the cooking compartment; and 4) energizing the microwave generator to vaporize the water in the pores of the wall to form steam whereby said steam is prevented from passing through the waterproof layer of the wall and said steam thereby enters the enclosure containing the product so that the product is at least partially cooked by the steam within the enclosure.

3. An apparatus for baking or heating products for use in combination with a microwave oven; said microwave oven having a microwave generator and an open ended cooking chamber with a door attached to the open end of the chamber; said apparatus comprising an insertable enclosure for insertion into said cooking chamber; said enclosure having an open end coincident with the open end of the cooking chamber when inserted into said chamber; said enclosure having a microwave permeable porous layer facing the interior of the enclosure and a microwave permeable waterproof layer capable of resisting a temperature of at least 100° C. facing the exterior of the enclosure so that when the oven is energized steam may be produced and said steam is confined to the enclosure whereby products placed in the enclosure may be at least partially cooked by the action of the steam.

4. The apparatus of claim 3 wherein said insertable enclosure is bell shaped.

5. The apparatus of claim 4 wherein the bell shaped insertable enclosure is in a shape which is homothetic to the cooking chamber of the microwave oven.

6. The apparatus of claim 3 wherein the enclosure is in the form of a casing which lines the cooking chamber of the oven said casing being open on the front face thereof.

7. The apparatus of claim 6 wherein the casing has one wall which is adapted to be adjacent to one external face of the wave guide in a microwave oven and said enclosure being surrounded by a microwave reflecting jacket which surrounds the faces of the casing which are not adjacent to the wave guide.

8. The apparatus of claims 6 or 7 wherein the casing contains at least one duct and connecting means for connecting the duct to a source of water.

9. The apparatus of claim 8 wherein the connecting means includes a cock.

10. An apparatus for baking or treating products which comprises a microwave oven having a microwave generator, a wave guide and an open ended cooking chamber with a door attached to the open end of the chamber; said chamber having an insert contained therein; said insert comprising an enclosure having an open end coincident with the open end of the cooking chamber; said enclosure having a microwave permeable porous layer facing the interior of the enclosure and a microwave permeable waterproof layer capable of resisting a temperature of at least 100° C. facing the exterior of the enclosure so that when the oven is energized steam may be produced and said steam is confined to the enclosure whereby products placed in the enclosure may be at least partially cooked by the action of the steam.

11. The apparatus of claim 10 wherein the enclosure is in the form of a casing which lines the cooking chamber of the oven; said casing being open on the front face thereof to form an opening which is coincident with the open end of the cooking chamber.

12. The apparatus of claim 11 wherein the casing has one wall which is adjacent to one external face of the wave guide in the microwave oven and said enclosure is surrounded by a microwave reflecting jacket which surrounds the faces of the casing which are not adjacent to the wave guide.

13. The apparatus of claims 11 or 12 wherein the casing contains at least one duct and connecting means for connecting the duct to a source of water.

14. The apparatus of claim 13 wherein the connecting means includes a cock.

15. The apparatus of claim 14 wherein the casing comprises at least one duct connected to the source of water wherein the connection includes a cock having an electrovalve which is fed by controlling a selective switch or a timing switch, the operation of which is included in the oven working cycle.

16. An apparatus for making or treating products which comprises a microwave oven having a microwave generator; a wave guide and a plurality of walls which define an open ended cooking chamber with a door attached to the open end of the chamber; said chamber having an insert contained therein; said insert being in the form of a plate having two faces and two parallel sides; said plate being formed of a porous microwave permeable material for holding a reservoir of water with one face of the plate having a porous material exposed and the other face of the plate being covered with a water proof layer which is permeable to microwaves and which can withstand a temperature of at least 100° C.; said insert being mounted in the chamber whereby an enclosure is formed between the walls of the chamber and the plate mounted therein with the proviso that the face having the exposed porous material faces the interior of the enclosure.

* * * * *